US012716378B1

(12) United States Patent
Lehmen et al.

(10) Patent No.: US 12,716,378 B1
(45) Date of Patent: Aug. 25, 2026

(54) METHODS AND SYSTEMS FOR PARTICULATE FILTER SENSOR

(71) Applicant: Ford Global Technologies, LLC, Dearborn, MI (US)

(72) Inventors: Allen Lehmen, Howell, MI (US); Adam Krach, Canton, MI (US); William Goodwin, Farmington Hills, MI (US); Sumanth Reddy Dadam, New Hudson, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 19/204,296

(22) Filed: May 9, 2025

(51) Int. Cl.
*F01N 11/00* (2006.01)
*F01N 3/021* (2006.01)

(52) U.S. Cl.
CPC ..... *F01N 11/002* (2013.01); *F01N 3/021* (2013.01); *F01N 2560/08* (2013.01); *F01N 2900/0416* (2013.01)

(58) Field of Classification Search
CPC .... F01N 2550/04; F01N 11/002; F01N 3/021; F01N 2900/1406; F01N 3/023; F01N 2550/00; F01N 2560/08
See application file for complete search history.

(56) References Cited

U.S. PATENT DOCUMENTS

| | | | | |
|---|---|---|---|---|
| 10,054,070 | B2 | 8/2018 | Dudar et al. | |
| 10,533,506 | B2 | 1/2020 | Dudar | |
| 11,073,063 | B2 * | 7/2021 | Van Nieuwstadt | F01N 11/002 |
| 11,846,242 | B2 * | 12/2023 | Dudar | F01N 3/023 |
| 2017/0102311 | A1 * | 4/2017 | Zhang | G01M 15/106 |
| 2017/0342923 | A1 * | 11/2017 | Zhang | G01N 15/0656 |
| 2019/0048776 | A1 * | 2/2019 | Van Nieuwstadt | F01N 1/168 |
| 2019/0048777 | A1 | 2/2019 | Rollinger et al. | |
| 2023/0212995 | A1 * | 7/2023 | Dudar | F01N 11/002 60/274 |

FOREIGN PATENT DOCUMENTS

| | | | |
|---|---|---|---|
| CN | 103907020 | B | 10/2017 |
| CN | 105464824 | B | 4/2018 |
| CN | 114517746 | A | 5/2022 |
| DE | 102014209840 | A1 | 11/2015 |
| DE | 102015119416 | A1 | 5/2016 |
| FR | 2980522 | A3 | 3/2013 |

* cited by examiner

*Primary Examiner* — Anthony Ayala Delgado
(74) *Attorney, Agent, or Firm* — McCoy Russell LLP

(57) ABSTRACT

Systems and methods for evaluating operation of a differential pressure sensor are disclosed. In one example, the differential pressure sensor may be configured to sense a pressure drop across a particulate filter. An operational assessment of the differential pressure sensor may determine whether or not a reference port of the differential pressure may be temporarily clogged.

20 Claims, 5 Drawing Sheets

METHODS AND SYSTEMS FOR PARTICULATE FILTER SENSOR

FIELD

The present description relates to a system and methods for operating an engine that includes a pressure based particulate filter sensor.

BACKGROUND AND SUMMARY

An internal combustion engine may generate carbonaceous soot from time to time. This carbonaceous soot may be trapped in a particulate filter where it may be stored up to a time when it may be desirable to combust the carbonaceous soot. One way of determining whether or not it may be desirable to combust the carbonaceous soot may be based on a pressure drop across the particulate filter. If the pressure drop across the particulate filter exceeds a threshold level, it may be desirable to combust and purge the carbonaceous soot from the particulate filter. Since the pressure drop across the particulate filter or differential pressure is compared to a threshold level, it may be desirable to determine whether or not the differential pressure measurement is rational so that purging of the particulate filter may begin or may be delayed.

The inventors herein have developed a method for operating an engine that includes a particulate filter in an exhaust system, comprising: operating the engine with a baseline particulate filter purging strategy and not indicating degradation of a differential pressure sensor in response to an upstream pressure indication of a differential pressure sensor being less than first pressure threshold, a downstream pressure indication of the differential pressure sensor being less than the first threshold, and a differential pressure between the upstream pressure indication and the downstream pressure indication being less than a second pressure threshold.

By evaluating outputs of a differential pressure sensor that monitors a pressure drop across a particulate filter while an engine upstream of the particulate filter is stopped, it may be possible to determine whether or not the differential pressure sensor is outputting pressure indications that may be influenced by a clogged or blocked reference port. Consequently, engine control and particulate filter purging may be influenced in response to the differential pressure sensor evaluation.

The present description may provide several advantages. In particular, the approach may determine whether or not differential pressure sensor output is reasonable and/or accurate. Further, the approach may help to reduce a possibility of false pressure sensor degradation indications. Additionally, the approach may be applied to petrol or diesel engines.

The above advantages and other advantages, and features of the present description will be readily apparent from the following Detailed Description when taken alone or in connection with the accompanying drawings.

It may be understood that the summary above is provided to introduce in simplified form a selection of concepts that are further described in the detailed description. It is not meant to identify key features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
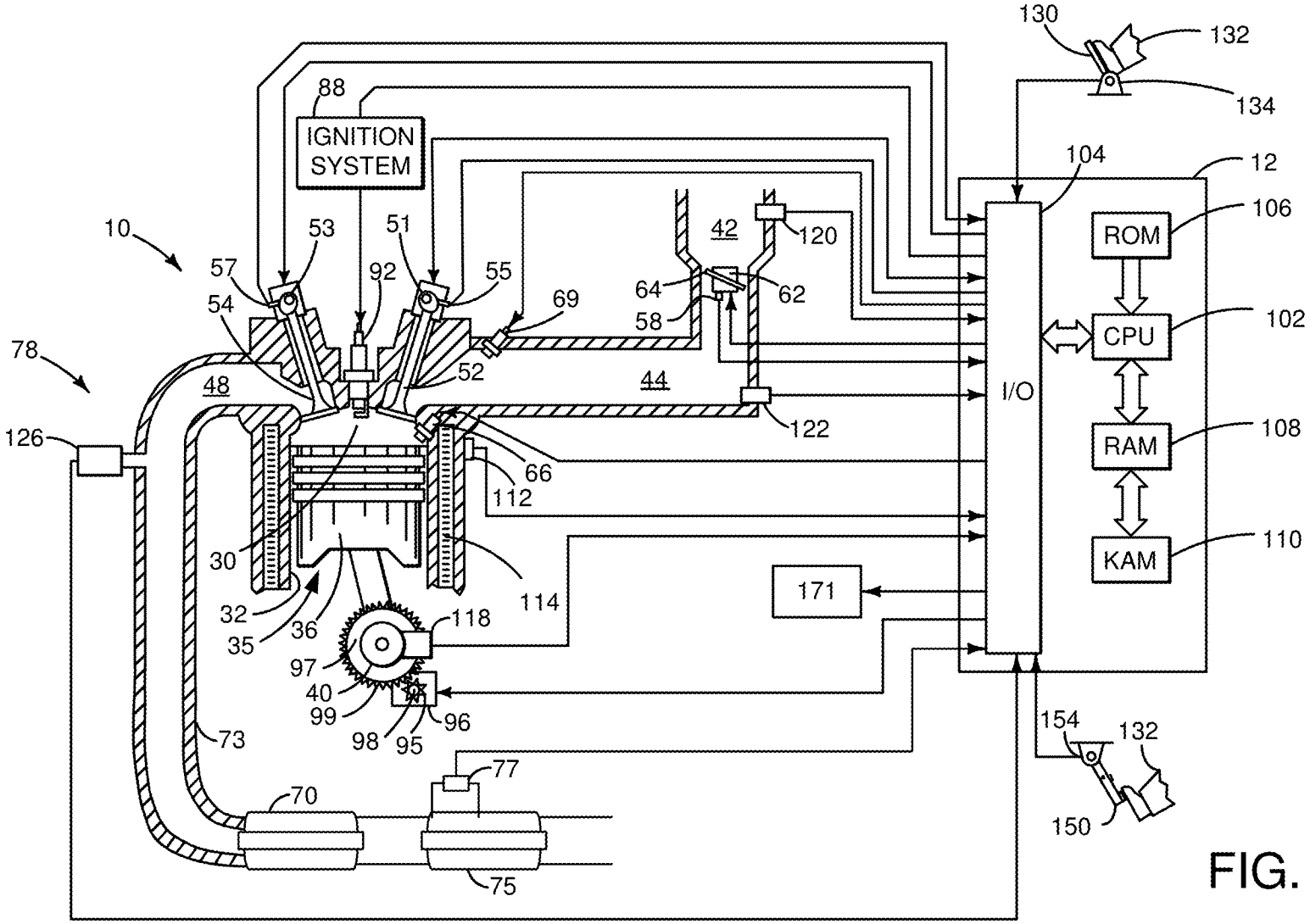
FIG. 1 is a schematic diagram of a single cylinder of an engine that includes a particulate filter.
Figure 3:
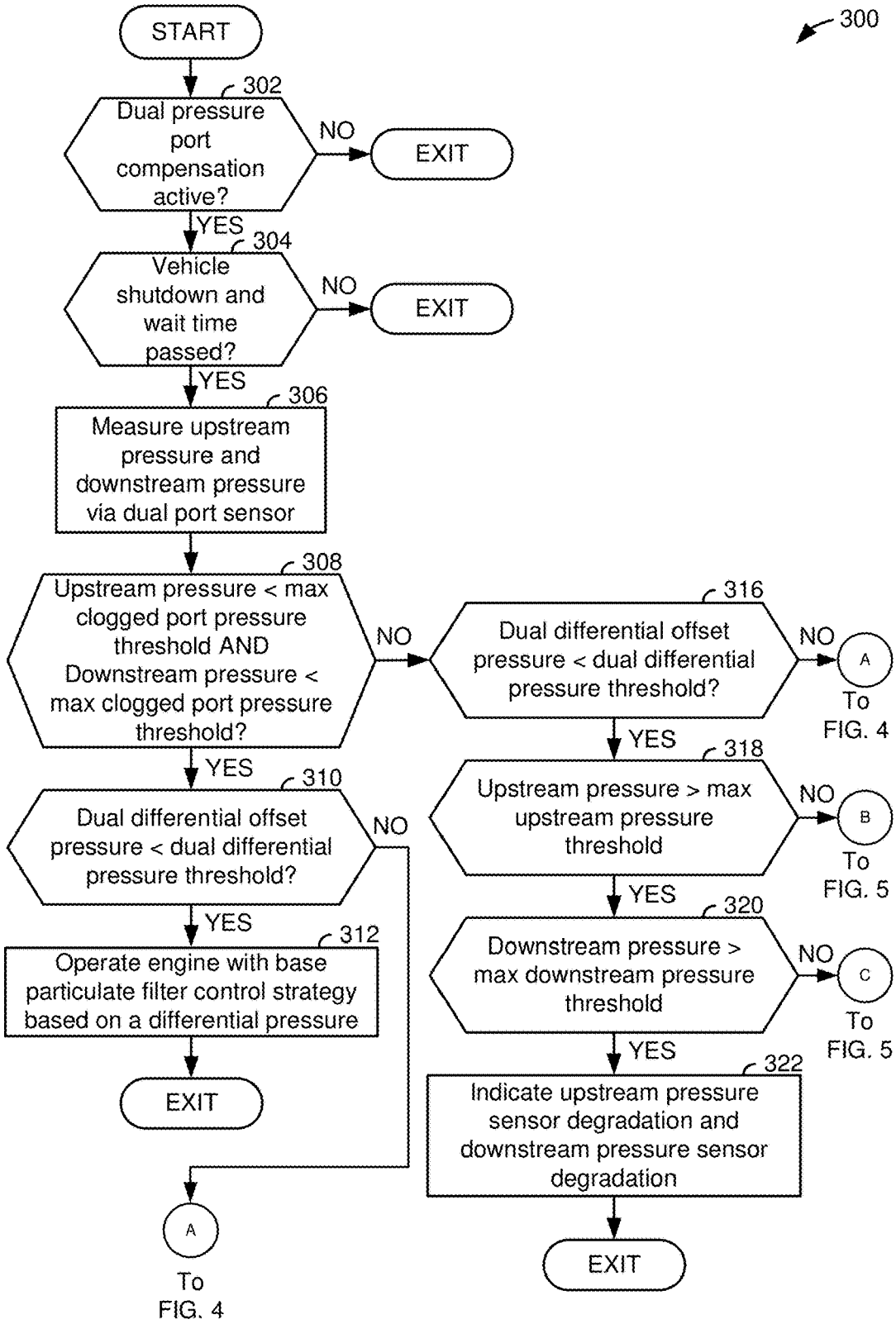
FIGS. 3-5 show a flowchart of an example method for operating an engine having a particulate filter and differential pressure sensor.
Figure 4:
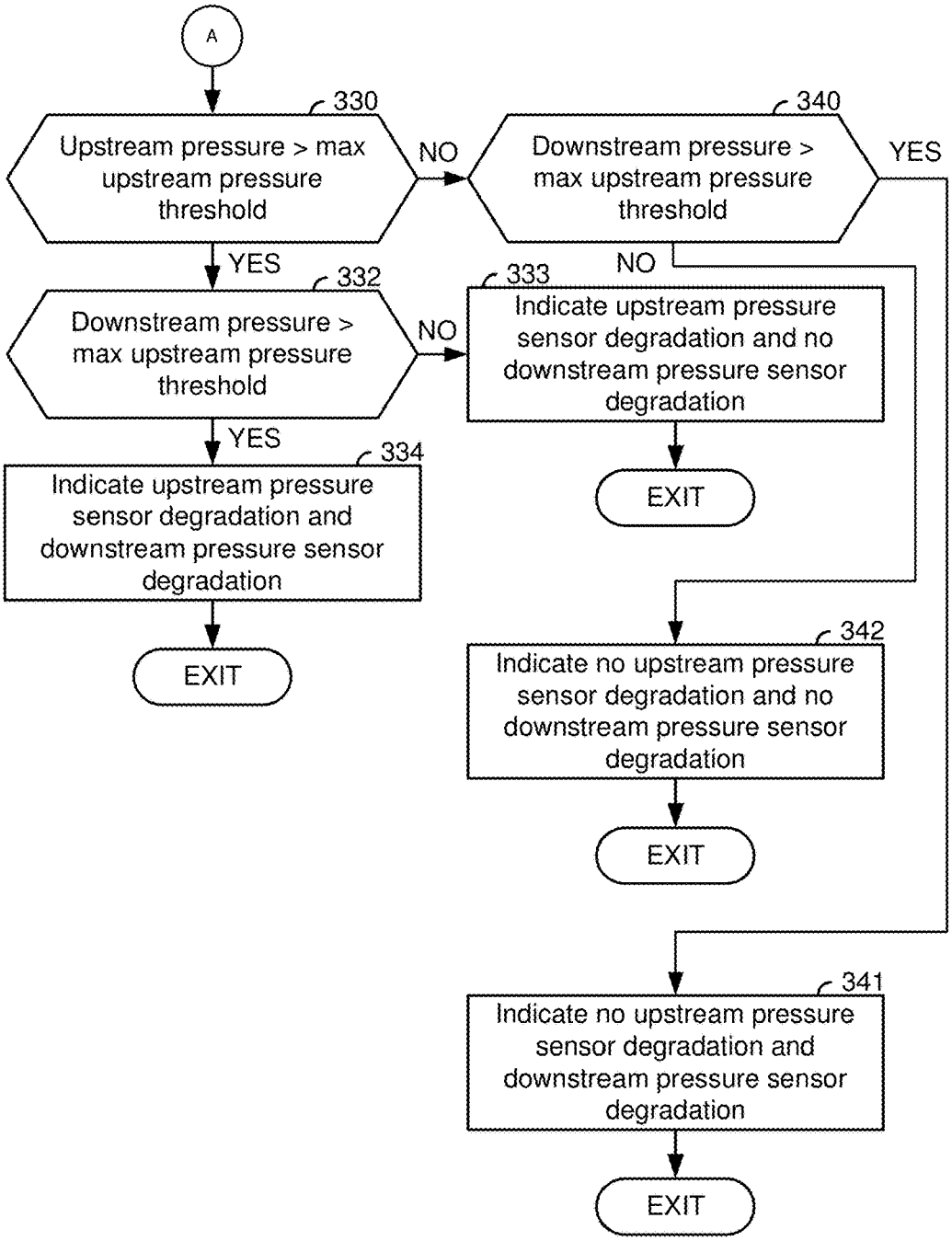
Figure 5:
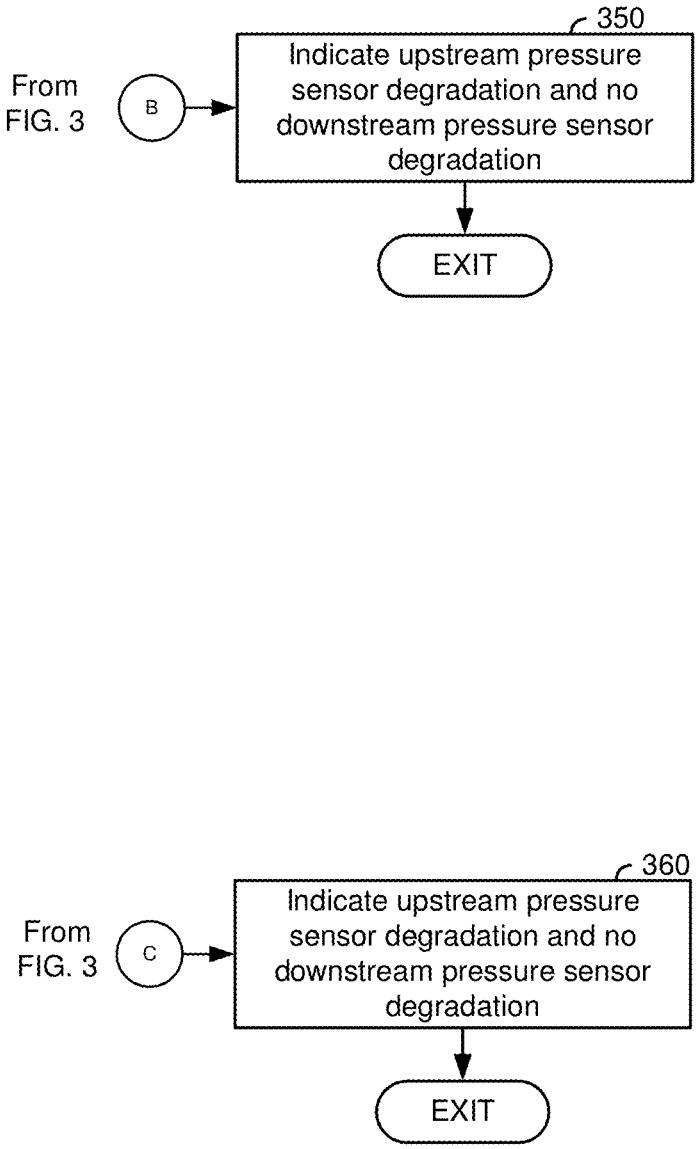

The present description is related to operating an engine with a differential pressure sensor that senses a pressure drop across a particulate filter. The approach provides a way of determining a presence or absence of a differential pressure sensor with a clogged reference port. If a clogged reference port is determined to be present, the approach may continue operating the engine according to a base particulate filter purging strategy without indicating a presence of pressure sensor degradation. However, if a clogged reference port is not determined, the approach may indicate degradation of particulate filter pressure sensors according to pressure sensor output. The engine may be an internal combustion engine that includes multiple cylinders, an example of one cylinder of the engine is shown in FIG. 1. The engine may purge carbonaceous soot from a particulate filter according to output of a differential pressure sensor. An example differential pressure sensor is shown in FIG. 1. A method of operating an engine with a differential pressure sensor and a particulate filter is shown in FIGS. 3-5.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Flywheel 97 and ring gear 99 are coupled to crankshaft 40. Starter 96 includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via an energy transfer device (e.g., a chain). In one example, starter 96 is in a base state when not engaged to the engine crankshaft. Combustion chamber 30 is shown communicating with intake manifold 44 and exhaust manifold 48 via respective intake valve 52 and exhaust valve 54. Each intake and exhaust poppet valve may be operated by an intake cam 51 and an exhaust cam 53. The position of intake cam 51 may be determined by intake cam sensor 55. The position of exhaust cam 53 may be determined by exhaust cam sensor 57.

Direct fuel injector 66 is shown positioned to inject fuel directly into cylinder 35, which is known to those skilled in the art as direct injection. Direct fuel injector 66 delivers liquid fuel in proportion to a voltage pulse width or fuel injector pulse width of a signal from controller 12. Fuel is delivered to fuel injector 66 by a fuel system (not shown) including a fuel tank, fuel pump, and fuel rail (not shown). Alternatively, or in addition, engine 10 may also include a port fuel injector 69 for each cylinder, which is known to those skilled in the art as port fuel injection. Port fuel injector 69 delivers liquid fuel in proportion to a voltage pulse width or fuel injector pulse width of a signal from controller 12. Fuel may be supplied to port fuel injector 69 via the fuel system (not shown).

Intake manifold 44 is shown communicating with optional electronic throttle 62 which adjusts a position of throttle plate 64 to control air flow from air intake 42 to intake manifold 44. In some examples, throttle 62 and throttle plate 64 may be positioned between intake valve 52 and intake manifold 44 such that throttle 62 is a port throttle.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Exhaust system 78 is shown with catalytic converter 70 and particulate filter 75 positioned along pipe 73. Particulate filter 75 is shown downstream of catalytic converter according to a direction of exhaust flow from the engine. Differential pressure sensor 77 is shown positioned to sense a pressure difference across particulate filter 75.

Controller 12 is shown in FIG. 1 as a conventional microcomputer including: microprocessor unit 102, input/output ports 104, read-exclusive memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to a driver demand pedal 130 for sensing a distance displaced by human 132; a position sensor 154 coupled to caliper control pedal 150 for sensing distance displaced by human 132, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses each revolution of the crankshaft from which engine speed (RPM) can be determined.

In some examples, the engine may be coupled to an electric motor/battery system in a hybrid vehicle. Further, controller 12 may receive input and communicate conditions such as degradation of components to illuminate a light, or alternatively, to human/machine interface 171 (touch screen display and input device).

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Figure 2:
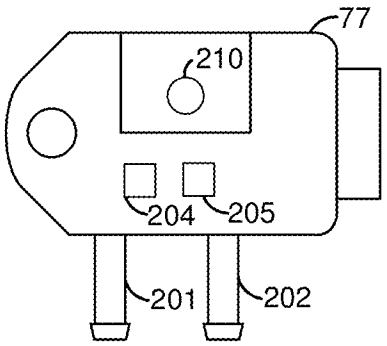
FIG. 2 is a schematic diagram of a dual port differential pressure sensor for sensing a pressure drop across a particulate filter.

Referring now to FIG. 2, a plan view of differential pressure sensor 77 is shown. Differential pressure sensor 77 includes a first pressure port 201 (an upstream pressure port) and a second pressure port 202 (a downstream pressure port). First pressure port 201 may be fluidically coupled to location in an exhaust system that is upstream of particulate filter 75 shown in FIG. 1 via a hose or passage. First pressure port 201 provides a passage to upstream pressure sensor 204. Second pressure port 202 may be fluidically coupled to location in an exhaust system that is downstream of particulate filter 75 shown in FIG. 1 via a hose or passage. Second pressure port 202 provides a passage to downstream pressure sensor 205. Both upstream pressure sensor 204 and downstream pressure sensor 205 provide a pressure signal that is referenced to pressure at reference port 210, which is exposed to ambient air and barometric pressure. The output of second pressure sensor 205 may be subtracted from output of first pressure sensor 204 to determine the differential pressure drop across the particulate filter (e.g., 75 shown in FIG. 1). The outputs of first pressure sensor 204 and second pressure sensor 205 are gauge pressures.

Differential pressure sensor 77 may be positioned on an outside of a vehicle near the vehicle's undercarriage to allow the pressure ports (e.g., 201 and 202) to access exhaust pressures. Therefore, from time to time, it may be possible for water to enter reference port 210 so that reference port 210 becomes temporarily clogged. If reference port 210 is clogged, outputs of upstream pressure sensor 204 and downstream pressure sensor 205 may increase such that they may output erroneous values or readings of exhaust pressure. Once the water evaporates and the differential pressure sensor 77 becomes unclogged, output of the differential pressure sensor pressure sensors returns to normal or expected values. Therefore, it may be desirable to not report degradation of the differential pressure sensor.

The system of FIGS. 1 and 2 provides for an engine system, comprising: an internal combustion engine including a particulate filter and a differential pressure sensor configured to sense a pressure difference across at least a portion of the particulate filter; and a controller including executable instructions stored in non-transitory memory that cause the controller to operate the internal combustion engine and not indicate degradation of the differential pressure sensor in response to an upstream pressure indication of the differential pressure sensor being less than first pressure threshold, a downstream pressure indication of the differential pressure sensor being less than the first threshold, and a differential pressure between the upstream pressure indication and the downstream pressure indication being less than a second pressure threshold. In a first example, the system further comprises additional executable instructions that cause the controller to indicate degradation of the differential pressure sensor in response to the differential pressure between the upstream pressure indication and the downstream pressure indication being greater than the second pressure threshold. In a second example that may include the first example, the system further comprises additional executable instructions that cause the controller to determine the upstream pressure indication and the downstream pressure indication while the internal combustion engine is stopped rotating. In a third example that may include one or both of the first and second examples, the system further comprises additional executable instructions that cause the controller to not indicate degradation of the differential pressure sensor in response to the upstream pressure indication of the differential pressure sensor being greater than a third pressure threshold, the third pressure threshold less than the first threshold. In a fourth example that may include one or more of the first through third examples, the system includes where the first threshold is based on a clogged reference port of the differential pressure sensor. In a fifth example that may include one or more of the first through fourth examples, the system includes where the third threshold is based on an unclogged reference port of the differential pressure sensor. In a sixth example that may include one or more of the first through fifth examples, the system further comprises additional controller instructions that cause the controller to operate with a base particulate filter control strategy that is based on output of the differential pressure sensor.

Referring now to FIGS. 3-5, a method 300 for operating an engine with a differential pressure sensor configured to sense a pressure drop across a particulate filter is shown. The method of FIGS. 3-5 may be incorporated into the system of FIGS. 1 and 2 as executable instructions stored in non-transitory memory. The method of FIGS. 3-5 may cause the controller shown in FIG. 1 to receive inputs from one or more sensors described herein and adjust positions or operating states of one or more actuators described herein in the physical world.

At 302, method 300 judges whether or not compensation for a duel pressure port sensor (e.g., a differential pressure sensor) compensation is active. Duel pressure port sensor compensation may be provided for a differential pressure sensor as shown in FIG. 2 that is configured to sense a pressure drop across a particulate filter. In one example, a value of a variable stored in controller memory may be indicative of whether or not compensation for output of a differential pressure sensor is activated. If so, the answer is yes and method 300 proceeds to 304. Otherwise, the answer is no and method 300 proceeds to exit.

At 304, method 300 judges whether or not an engine of a vehicle in which method 300 operates has stopped rotating (e.g., is shutdown) and if a predetermined amount of time has passed since the engine has most recently stopped rotating. If so, the answer is yes and method 300 proceeds to 306. Otherwise, the answer is no and method 300 proceeds to exit. Stopping engine rotation and allowing a predetermined amount of time lets pressure in the engine's exhaust system stabilize to at or near atmospheric pressure. Thus, pressure throughout the engine's exhaust system may be uniform. This may allow method 300 to determine whether or not one or both pressure sensors included in a differential pressure sensor is outputting erroneous data.

At 306, method 300 measures pressure in the engine's exhaust system at a location that is upstream of a particulate filter via a pressure sensor included in a differential pressure sensor. Method 300 also measures pressure in the engine's exhaust system at a location that is downstream of a particulate filter via a pressure sensor included in the differential pressure sensor. Method 300 proceeds to 308.

At 308, method 300 judges whether or not an upstream pressure in an exhaust system (e.g., an upstream offset pressure) is less than a maximum clogged port pressure for the differential pressure sensor and a downstream pressure in the exhaust system (e.g., a downstream offset pressure) is less than the maximum clogged port pressure for the differential pressure sensor. If so, the answer is yes and method 300 proceeds to 310. Otherwise, the answer is no and method 300 proceeds to 316.

The maximum clogged port pressure is a pressure that is based on a reference port of the differential pressure sensor being clogged (e.g., temporarily obstructed via water) is a pressure value that is greater than a maximum non-clogged port pressure. The output of an upstream or downstream pressure sensor that exceeds the maximum clogged port pressure may be indicative of a reference port that may be temporarily clogged with water.

Additionally, in some examples, the upstream pressure may be generated by adding a learned upstream pressure offset value to a raw upstream pressure value. The raw upstream pressure value being directly output from the upstream pressure sensor of the differential pressure sensor. Similarly, the downstream pressure may be generated by adding a learned downstream pressure offset value to a raw downstream pressure value. The raw downstream pressure value being directly output from the downstream pressure sensor of the differential pressure sensor.

At 310, method 300 judges whether or not a dual differential pressure (e.g., a difference in pressure between the upstream pressure in an exhaust system and the downstream pressure in the exhaust system) is less than a differential offset pressure threshold. If so, the answer is yes and method 300 proceeds to 312. Otherwise, the answer is no and method 300 proceeds to 330. The differential pressure evaluation along with the upstream and downstream offset pressure evaluations may be indicative of a clogged reference port of a differential pressure sensor.

At 312, method 300 indicates that the upstream and downstream pressure sensors in the differential pressure sensor are not degraded. Further, method 300 operates the engine (e.g., the engine rotates while combusting fuel) with a baseline particulate filter purging strategy. The baseline particulate filter purging strategy may adjust engine operation (e.g., spark timing, fuel injection timing, etc.) to facilitate combustion of carbonaceous soot in the engine's particulate filter in response to a differential pressure determined via output of the differential pressure sensor and an open-loop soot model. Method 300 proceeds to exit.

At 316, method 300 judges whether or not a dual differential pressure (e.g., a difference in pressure between the upstream pressure in an exhaust system and the downstream pressure in the exhaust system) is less than a differential offset pressure threshold. If so, the answer is yes and method 300 proceeds to 318. Otherwise, the answer is no and method 300 proceeds to 330.

At 318, method 300 judges whether or not an upstream pressure in an exhaust system (e.g., an upstream offset pressure) is greater than a maximum upstream pressure threshold for the differential pressure sensor. The maximum upstream pressure threshold for the differential pressure sensor is less than the maximum clogged port pressure threshold for the differential pressure sensor because a clogged reference port may lead to higher upstream and downstream pressure indications from the differential pressure sensor. If method 300 judges that the upstream pressure in the exhaust system is greater than a maximum upstream pressure threshold value, the answer is yes and method 300 proceeds to 320. Otherwise, the answer is no and method 300 proceeds to 350.

At 320, method 300 judges whether or not a downstream pressure in an exhaust system (e.g., an upstream offset pressure) is greater than a maximum downstream pressure threshold for the differential pressure sensor. The maximum downstream pressure threshold for the differential pressure sensor is less than the maximum clogged port pressure threshold for the differential pressure sensor because a clogged reference port may lead to higher upstream and downstream pressure indications from the differential pressure sensor. If method 300 judges that the downstream pressure in the exhaust system is greater than a maximum downstream pressure threshold value, the answer is yes and method 300 proceeds to 322. Otherwise, the answer is no and method 300 proceeds to 360.

At 322, method 300 indicates that the upstream pressure sensor of the differential pressure sensor is degraded and the downstream pressure sensor of the differential pressure sensor is degraded. Method 300 may indicate that the pressure sensors are degraded or not degraded via the vehicle's HMI. Further, method 300 does not operate the engine with a baseline particulate filter purging strategy. Instead, method 300 may temporarily suspend particulate filter purging that is based on pressure, and instead, purge the particulate filter based on the open-loop soot model output without particulate filter pressure feedback. Method 300 proceeds to exit.

At 330, method 300 judges whether or not an upstream pressure in an exhaust system (e.g., an upstream offset pressure) is greater than a maximum upstream pressure threshold for the differential pressure sensor. The maximum upstream pressure threshold for the differential pressure sensor is less than the maximum clogged port pressure threshold for the differential pressure sensor because a clogged reference port may lead to higher upstream and downstream pressure indications from the differential pressure sensor. If method 300 judges that the upstream pressure in the exhaust system is greater than a maximum upstream pressure threshold value, the answer is yes and method 300 proceeds to 332. Otherwise, the answer is no and method 300 proceeds to 340.

At 332, method 300 judges whether or not a downstream pressure in an exhaust system (e.g., an upstream offset pressure) is greater than a maximum downstream pressure threshold for the differential pressure sensor. The maximum downstream pressure threshold for the differential pressure sensor is less than the maximum clogged port pressure threshold for the differential pressure sensor because a clogged reference port may lead to higher upstream and downstream pressure indications from the differential pressure sensor. If method 300 judges that the downstream pressure in the exhaust system is greater than a maximum downstream pressure threshold value, the answer is yes and method 300 proceeds to 334. Otherwise, the answer is no and method 300 proceeds to 333.

At 333, method 300 indicates that the upstream pressure sensor of the differential pressure sensor is degraded and the downstream pressure sensor of the differential pressure sensor is not degraded. Method 300 may indicate that the upstream pressure sensor and downstream pressure sensors are degraded or not degraded via the vehicle's HMI. Further, method 300 does not operate the engine with a baseline particulate filter purging strategy. Instead, method 300 may temporarily suspend particulate filter purging that is based on pressure and purge the particulate filter based on the open-loop soot model output without particulate filter pressure feedback. Method 300 proceeds to exit.

At 334, method 300 indicates that the upstream pressure sensor of the differential pressure sensor is degraded and the downstream pressure sensor of the differential pressure sensor is degraded. Method 300 may indicate that the pressure sensors are degraded or a not degraded via the vehicle's HMI. Further, method 300 does not operate the engine with a baseline particulate filter purging strategy. Instead, method 300 may temporarily suspend particulate filter purging that is based on pressure and purge the particulate filter based on the open-loop soot model output without particulate filter pressure feedback. Method 300 proceeds to exit.

At 340, method 300 judges whether or not a downstream pressure in an exhaust system (e.g., an upstream offset pressure) is greater than a maximum downstream pressure threshold for the differential pressure sensor. The maximum downstream pressure threshold for the differential pressure sensor is less than the maximum clogged port pressure threshold for the differential pressure sensor because a clogged reference port may lead to higher upstream and downstream pressure indications from the differential pressure sensor. If method 300 judges that the downstream pressure in the exhaust system is greater than a maximum downstream pressure threshold value, the answer is yes and method 300 proceeds to 341. Otherwise, the answer is no and method 300 proceeds to 342.

At 341, method 300 indicates that the upstream pressure sensor of the differential pressure sensor is not degraded and the downstream pressure sensor of the differential pressure sensor is degraded. Method 300 may indicate that the pressure sensors are degraded or not degraded via the vehicle's HMI. Further, method 300 does not operate the engine with a baseline particulate filter purging strategy. Instead, method 300 may temporarily suspend particulate filter purging that is based on pressure and purge the particulate filter based on the open-loop soot model output without particulate filter pressure feedback. Method 300 proceeds to exit.

At 342, method 300 indicates that the upstream pressure sensor of the differential pressure sensor is not degraded and the downstream pressure sensor of the differential pressure sensor is not degraded. Method 300 may indicate that the pressure sensors are degraded or not degraded via the vehicle's HMI. Further, method 300 does not operate the engine with a baseline particulate filter purging strategy. Instead, method 300 may temporarily suspend particulate filter purging that is based on pressure and purge the particulate filter based on the open-loop soot model output without particulate filter pressure feedback. Method 300 proceeds to exit.

At 350, method 300 indicates that the upstream pressure sensor of the differential pressure sensor is degraded and the downstream pressure sensor of the differential pressure sensor is not degraded. Method 300 may indicate that the pressure sensors are degraded or not degraded via the vehicle's HMI. Further, method 300 does not operate the engine with a baseline particulate filter purging strategy. Instead, method 300 may temporarily suspend particulate filter purging that is based on pressure and purge the particulate filter based on the open-loop soot model output without particulate filter pressure feedback. Method 300 proceeds to exit.

At 360, method 300 indicates that the upstream pressure sensor of the differential pressure sensor is degraded and the downstream pressure sensor of the differential pressure sensor is not degraded. Method 300 may indicate that the pressure sensors are degraded or not degraded via the vehicle's HMI. Further, method 300 does not operate the engine with a baseline particulate filter purging strategy. Instead, method 300 may temporarily suspend particulate filter purging that is based on pressure and purge the particulate filter based on the open-loop soot model output without particulate filter pressure feedback. Method 300 proceeds to exit.

In this way, method 300 may distinguish which of an upstream pressure sensor and a downstream pressure sensor are degraded. Additionally, method 300 continue engine operation without indicating differential pressure sensor degradation when a reference port of the differential pressure sensor is clogged. Thus, method 300 may reduce a possibility of making false indications of a degraded differential pressure exhaust sensor.

Thus, method 300 provides for a method for operating an engine that includes a particulate filter in an exhaust system, comprising: operating the engine with a baseline particulate filter purging strategy and not indicating degradation of a differential pressure sensor in response to an upstream pressure indication of a differential pressure sensor being less than first pressure threshold, a downstream pressure indication of the differential pressure sensor being less than the first threshold, and a differential pressure between the upstream pressure indication and the downstream pressure indication being less than a second pressure threshold. In a first example, the method further comprises indicating a degradation of the differential pressure sensor in response to the differential pressure between the upstream pressure indication and the downstream pressure indication being greater than the second pressure threshold. In a second example that may include the first example, the method includes where the degradation of the differential pressure sensor indicates a degradation of an upstream pressure sensor or a downstream pressure sensor. In a third example that may include one or both of the first and second examples, the method includes where the upstream pressure indication of the differential pressure sensor and the downstream pressure indication of the differential pressure are produced while the engine is stopped rotating. In a fourth example that may include one or more of the first through third examples, the method includes where the differential pressure between the upstream pressure indication and the downstream pressure indication is determined via a controller. In a fifth example that may include one or more of the first through fourth examples, the method includes where the first pressure threshold is based on a reference port of a differential pressure sensor being clogged. In sixth example that may include one or more of the first through fifth examples, the method further comprises operating the engine with the baseline particulate filter purging strategy and not indicating degradation of a differential pressure sensor in response to an upstream pressure indication of a differential pressure sensor being greater than a third pressure threshold, the third pressure threshold less than the first threshold. In a seventh example that may include one or more of the first through sixth examples, the method includes where the third pressure threshold is based on a reference port of a differential pressure sensor not being clogged.

Method 300 also provides for a method for operating an engine that includes a particulate filter in an exhaust system, comprising: sensing an upstream pressure in the exhaust system upstream of the particulate filter in a direction of exhaust flow through the exhaust system while the engine has stopped rotating; sensing a downstream pressure in the exhaust system downstream of the particulate filter in the direction of exhaust flow through the exhaust system while the engine has stopped rotating; and operating the engine and not indicating degradation of a differential pressure sensor in response to a difference between the upstream pressure and the downstream pressure being less than a first threshold pressure while the upstream pressure and the downstream pressure are less than a second threshold pressure. In a first example, the method includes where the engine is operated with a baseline particulate filter purging strategy in response to the difference between the upstream pressure and the downstream pressure being less than the first threshold pressure while the upstream pressure and the downstream pressure are less than the second threshold pressure. In a second example that may include the first example, the method further comprises indicating degradation of an upstream pressure sensor and a downstream pressure sensor in response to the upstream pressure and the downstream pressure being greater than a third pressure threshold. In a third example that may include one or both of the first and second examples, the method further comprises differentiating determining degradation of an upstream pressure sensor from degradation of a downstream pressure sensor. In a fourth example that may include one or more of the first through third examples, the method includes where the upstream pressure sensor and the downstream pressure sensor are included in a differential pressure sensor.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example examples described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A method for operating an engine that includes a particulate filter in an exhaust system, comprising:

not indicating degradation of a differential pressure sensor in response to an upstream pressure indication of the differential pressure sensor being less than a first pressure threshold, a downstream pressure indication of the differential pressure sensor being less than the first pressure threshold, and a differential pressure between the upstream pressure indication and the downstream pressure indication being less than a second pressure threshold; and operating the engine with a baseline particulate filter purging strategy in response to not indicating degradation of the differential pressure sensor.

2. The method of claim 1, further comprising indicating degradation of the differential pressure sensor in response to the differential pressure between the upstream pressure indication and the downstream pressure indication being greater than the second pressure threshold.

3. The method of claim 2, where degradation of the differential pressure sensor indicates degradation of an upstream pressure sensor or a downstream pressure sensor.

4. The method of claim 1, where the upstream pressure indication of the differential pressure sensor and the downstream pressure indication of the differential pressure are produced while the engine is stopped rotating.

5. The method of claim 1, where the differential pressure between the upstream pressure indication and the downstream pressure indication is determined via a controller.

6. The method of claim 1, where the first pressure threshold is based on a reference port of the differential pressure sensor being clogged.

7. The method of claim 6, further comprising operating the engine with the baseline particulate filter purging strategy and not indicating degradation of the differential pressure sensor in response to the upstream pressure indication of the differential pressure sensor being greater than a third pressure threshold, the third pressure threshold less than the first pressure threshold.

8. The method of claim 7, where the third pressure threshold is based on the reference port of the differential pressure sensor not being clogged.

9. An engine system, comprising:

an internal combustion engine including a particulate filter and a differential pressure sensor configured to sense a pressure difference across at least a portion of the particulate filter; and a controller including executable instructions stored in non-transitory memory that cause the controller to operate the internal combustion engine and not indicate degradation of the differential pressure sensor in response to an upstream pressure indication of the differential pressure sensor being less than first pressure threshold, a downstream pressure indication of the differential pressure sensor being less than the first pressure threshold, and a differential pressure between the upstream pressure indication and the downstream pressure indication being less than a second pressure threshold.

10. The engine system of claim 9, further comprising additional executable instructions that cause the controller to indicate degradation of the differential pressure sensor in response to the differential pressure between the upstream pressure indication and the downstream pressure indication being greater than the second pressure threshold.

11. The engine system of claim 9, further comprising additional executable instructions that cause the controller to determine the upstream pressure indication and the downstream pressure indication while the internal combustion engine is stopped rotating.

12. The engine system of claim 9, further comprising additional executable instructions that cause the controller to not indicate degradation of the differential pressure sensor in response to the upstream pressure indication of the differential pressure sensor being greater than a third pressure threshold, the third pressure threshold less than the first pressure threshold.

13. The engine system of claim 12, where the first pressure threshold is based on a clogged reference port of the differential pressure sensor.

14. The engine system of claim 13, where the third pressure threshold is based on an unclogged reference port of the differential pressure sensor.

15. The engine system of claim 9, further comprising additional controller instructions that cause the controller to operate with a base particulate filter control strategy that is based on output of the differential pressure sensor.

16. A method for operating an engine that includes a particulate filter in an exhaust system, comprising:

sensing an upstream pressure in the exhaust system upstream of the particulate filter in a direction of exhaust flow through the exhaust system while the engine has stopped rotating;

sensing a downstream pressure in the exhaust system downstream of the particulate filter in the direction of exhaust flow through the exhaust system while the engine has stopped rotating; and operating the engine and not indicating degradation of a differential pressure sensor in response to a difference between the upstream pressure and the downstream pressure being less than a first threshold pressure while the upstream pressure and the downstream pressure are less than a second threshold pressure.

17. The method of claim 16, where the engine is operated with a baseline particulate filter purging strategy in response to the difference between the upstream pressure and the downstream pressure being less than the first threshold pressure while the upstream pressure and the downstream pressure are less than the second threshold pressure.

18. The method of claim 16, further comprising indicating degradation of an upstream pressure sensor and a downstream pressure sensor in response to the upstream pressure and the downstream pressure being greater than a third pressure threshold.

19. The method of claim 16, further comprising differentiating determining degradation of an upstream pressure sensor from degradation of a downstream pressure sensor.

20. The method of claim 19, where the upstream pressure sensor and the downstream pressure sensor are included in the differential pressure sensor.

* * * * *